US008659499B1

(12) United States Patent
Pluymers

(10) Patent No.: US 8,659,499 B1
(45) Date of Patent: Feb. 25, 2014

(54) FASTENER-LESS JOINT FOR RADAR ARRAY

(75) Inventor: Brian A. Pluymers, Haddonfield, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 869 days.

(21) Appl. No.: 12/688,450

(22) Filed: Jan. 15, 2010

(51) Int. Cl.
*H01Q 1/14* (2006.01)
*H01Q 21/00* (2006.01)

(52) U.S. Cl.
USPC ..... 343/879

(58) Field of Classification Search
USPC ..... 343/767, 770, 795, 853, 878, 879; 52/664, 668; 403/375
See application file for complete search history.

(56) References Cited

U.S. PATENT DOCUMENTS 4,001,834 A * 1/1977 Smith ..... 343/754
4,760,680 A * 8/1988 Myers ..... 52/669
5,309,165 A * 5/1994 Segal et al. ..... 343/770
5,431,582 A 7/1995 Carvalho et al.
5,459,474 A 10/1995 Mattioli et al.
6,469,671 B1 10/2002 Pluymers et al.
6,514,021 B2 2/2003 Delay
7,272,880 B1 9/2007 Pluymers et al.
7,508,338 B2 3/2009 Pluymers et al.
2008/0169973 A1 7/2008 Pluymers et al.

* cited by examiner

*Primary Examiner* — Michael C Wimer
(74) *Attorney, Agent, or Firm* — Howard IP Law Group, PC

(57) ABSTRACT

An antenna array lattice design is disclosed, comprising a plurality of column and row members that interconnect using a tongue and groove feature to result in a stable lattice arrangement. Each row and column member comprises a plurality of slots configured to receive corresponding slots of opposing row or column members. The slots have surfaces that run approximately one half the length or width of the associated member. The slot surfaces have recesses machined therein, and the recesses are shaped to accept correspondingly shaped projections of the opposing row or column member. In one embodiment, the recesses are T-shaped, as are the associated projections. The slots acts as a guide for the row to column attachment during assembly, while the precise geometry of the groove design allows both tensile and compressive forces to be carried across the entire depth of the joint, thus maximizing the stiffness/weight ratio of the resulting array lattice structure.

30 Claims, 17 Drawing Sheets

FASTENER-LESS JOINT FOR RADAR ARRAY

FIELD OF THE INVENTION

The invention generally relates to assembly arrangements for radar arrays, and more particularly to a high strength fastener-less joint for use in assembling radar arrays.

BACKGROUND OF THE INVENTION

Recent developments in solid state radar have revealed the advantage of utilizing a "lattice" type of structure for fabricating radar arrays in which horizontally oriented rows and vertically oriented columns interlock to form a stiff, strong array skeleton. When external thin, flat plates (referred to as "skins") are attached to the front and rear of this lattice, the resultant structure has a very high stiffness to weight ratio, much like a honeycomb panel. A high stiffness-to-weight ratio enables fabrication of lightweight array structures which are desirable for today's land, sea, and air based radar platforms.

An example of such an array skeleton is shown in FIG. 1. As can be seen, the array skeleton 1 includes a plurality of row members 2, a plurality of column coldplate members 4, a T/R coldplate 6 backing the row/array structures, and a radiator coldplate 8 disposed adjacent to the T/R coldplate 6. FIG. 2 is an isometric view of the rear of an octagonal array antenna "AT" illustrating a plurality of array skeletons "AS" populated with electronic elements. The radiating face of antenna "AT" of FIG. 2 is the side opposite to the illustrated side. FIG. 2 also illustrates a populated array skeleton "AS" broken away from antenna "AT". Populated array skeleton "AS" is thus a portion of, or a subset of a plurality of similar populated skeletons or lattices which together make up a portion of antenna array "AT." In FIG. 2, the rear portion of the populated array skeleton "AS" is closed by a plurality of electronic enclosure doors.

The row and column members 2, 4 utilized in typical array skeleton arrangements are slotted 10 at each row/column interface (FIG. 3A), such that they seat within each other when assembled (FIG. 3B). The disadvantage of such an arrangement, however, is that membrane forces are translated only along the back half "BH" of the column members 4 and the front half "FH" of the row members 2.

Other designs employ "L" brackets 12, (see FIG. 4) attached with mechanical fasteners (e.g., screws), and positioned at the interface between each row and column member 2, 4. The "L" brackets 12 provides the arrangement with increased stiffness because they allow membrane forces to be supported along the entire depth "D" of each row/column joint 14. While this approach provides a sound structural interface, it adds structure weight due to the numerous L-brackets 12 and fasteners. Furthermore, this approach adds significant cost to the array structure, both in materials and in touch labor. Significant assembly labor costs are associated with having to install the numerous fasteners. Further exacerbating this problem is the fact that these L-brackets 12 must be installed within the confined cavities formed by the interlocking rows/columns. Finally, the number of row/column interfaces 14 present in typical shipboard and land based arrays number in the hundreds, and can exceed 1000, depending on the size of the array aperture. Thus, the costs (material and installation labor) and weight associated with these L-brackets 12 can be significant.

To realize the full mechanical advantage (i.e. high stiffness/weight ratio) of the lattice structure, these row/column interfaces should be secured such that forces are translated continuously across the entire depth of each row/column, and thus subsequently along the length of each row/column. Thus, there is a need for an improved and simplified design for row/column interfaces that result in a high strength, high stiffness, joint, without the equipment and installation expense required of present high strength designs.

SUMMARY OF THE INVENTION

The disclosed arrangement provides a robust joint design for row/column interfaces in a solid state array lattice structure. The arrangement provides desired functionality without the need for cost-adding mechanical fasteners (screws, bolts, etc). Furthermore, the design enables self-fixturing of the row and column locations during array structure assembly, which reduces costs associated with fixturing and assembly labor.

An antenna array structure is disclosed, comprising first and second support members. The first and second support members having cooperating slots configured to allow the first and second support members to interlock to enable assembly of the first and second support members into a dimensionally stable lattice. The slots of the first and second support members comprise geometrically shaped slot edges configured to receive correspondingly shaped projections of an opposing first or second support member.

An antenna array lattice is disclosed, comprising a plurality of first and second support members each comprising cooperating slots configured to allow pairs of first and second support members to lock together into a dimensionally stable lattice. The slots of the plurality of first and second support members comprise geometrically shaped slot edges configured to receive correspondingly shaped projections of opposing first or second support members.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts, and further wherein.

DETAILED DESCRIPTION

Figure 1:
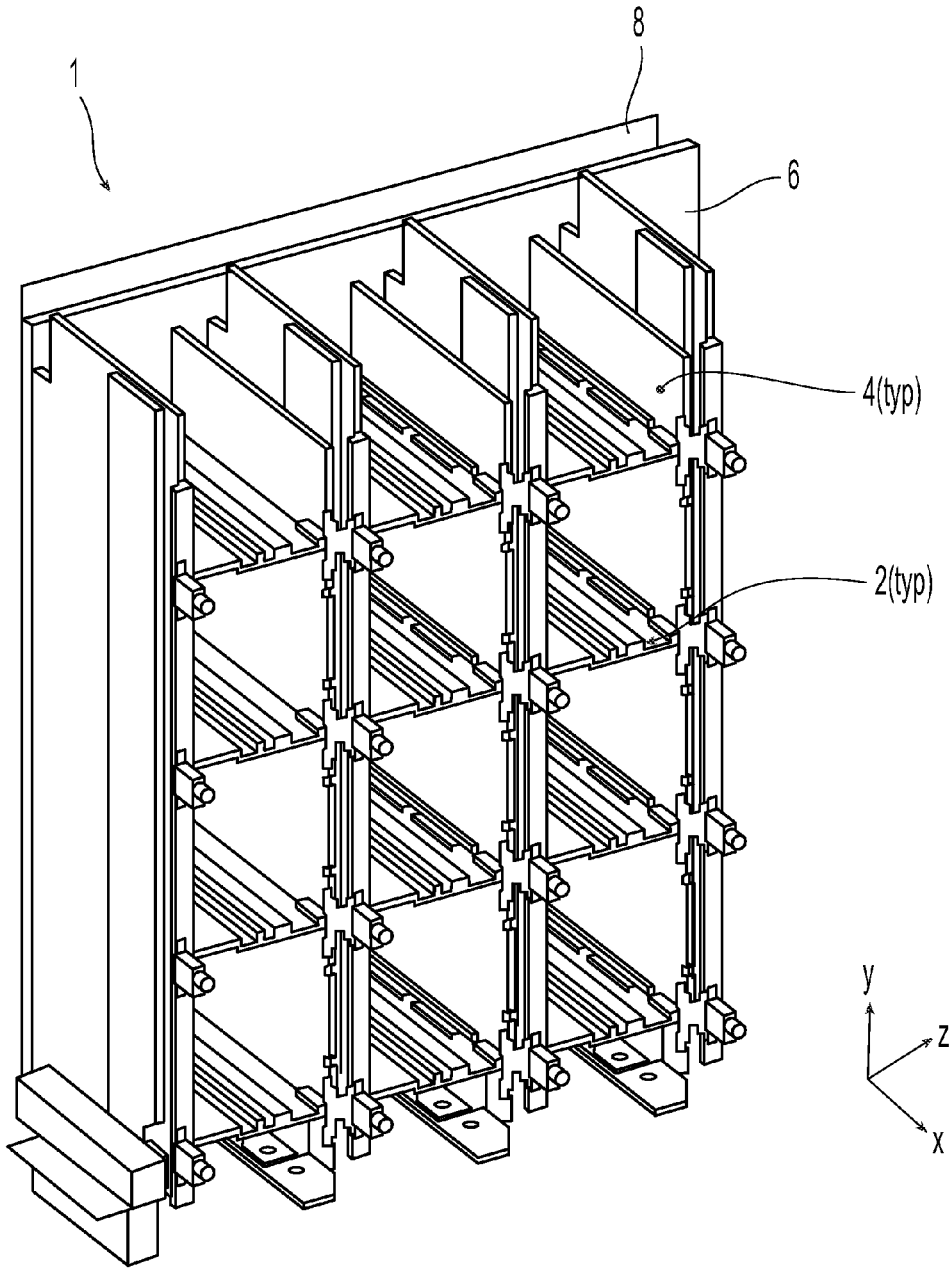
FIG. 1 is an isometric view of a portion of a radar array lattice.
Figure 2:
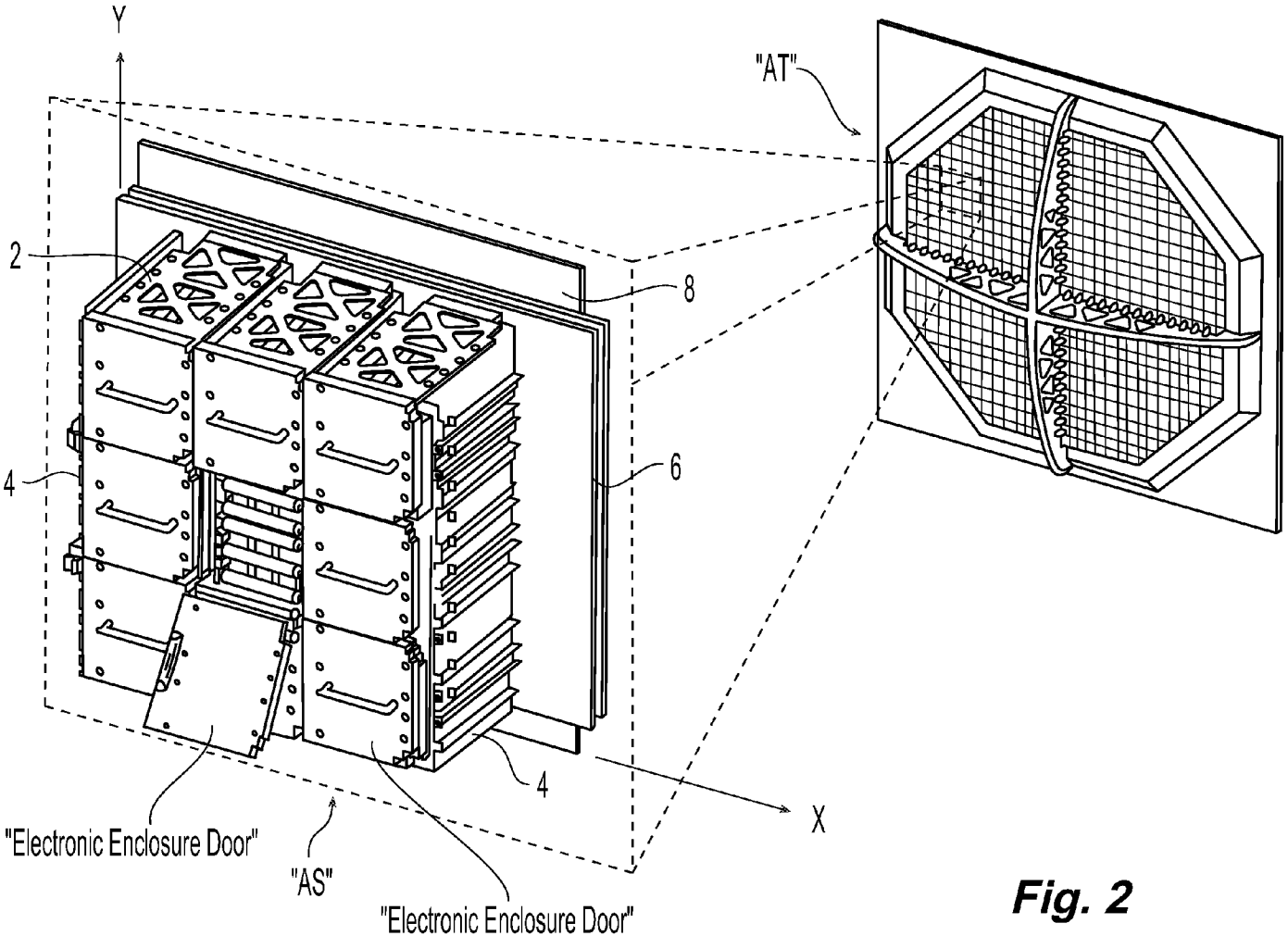
FIG. 2 is an isometric view of the rear of an octagonal array antenna illustrating an array of antenna electronic element lattices populated with electronic elements, and also illustrates a single one of the populated array lattices broken away from the antenna.
Figure 3A:
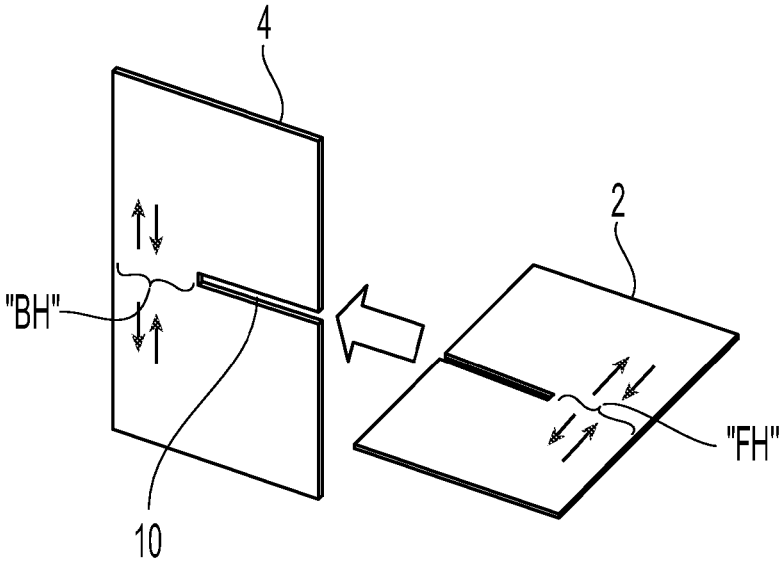
FIGS. 3A and 3B are isometric views of a traditional interface connection scheme (unassembled and assembled) between row and column members of a radar array lattice.
Figure 3B:
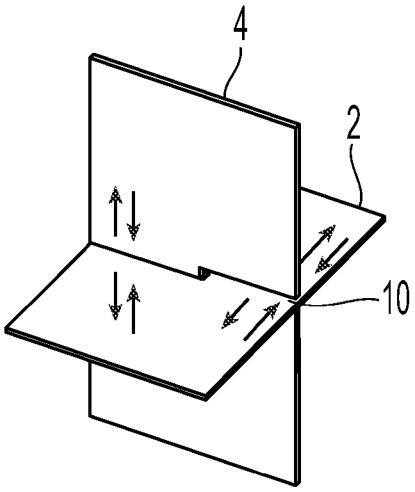
Figure 4:
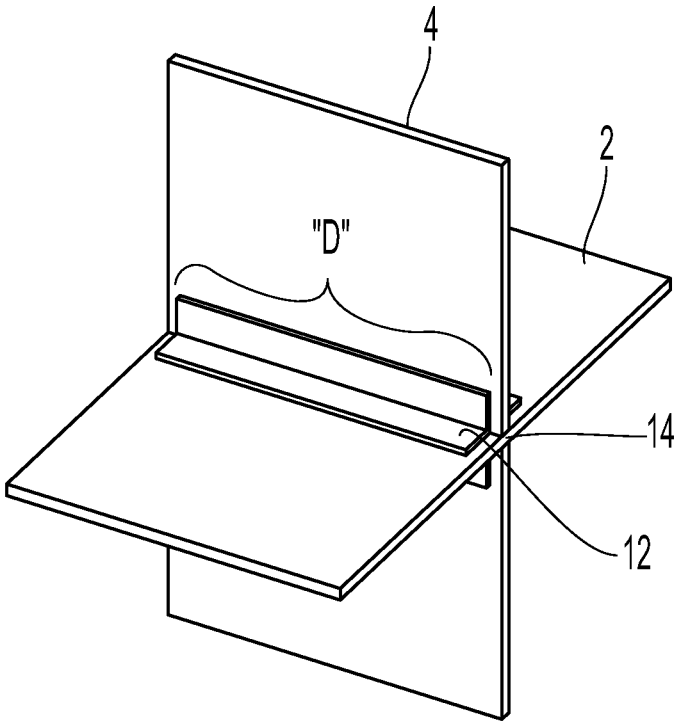
FIG. 4 is an isometric view of another traditional interface connection between row and column members of a radar array lattice.

In the accompanying drawings, like items are indicated by like reference numerals. This description of the preferred embodiments is intended to be read in connection with the accompanying drawings, which are to be considered part of the written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

In general, a tongue and groove feature is disclosed for engaging array row and column members. In one embodiment, a grooved slot is machined into the array row and column members. The grooved slot acts as a guide for the row to column attachment during assembly, while the precise geometry of the groove design allows both tensile and compressive forces to be carried across the entire depth of the joint, thus maximizing the stiffness/weight ratio of the resulting array lattice structure.

Figure 5:
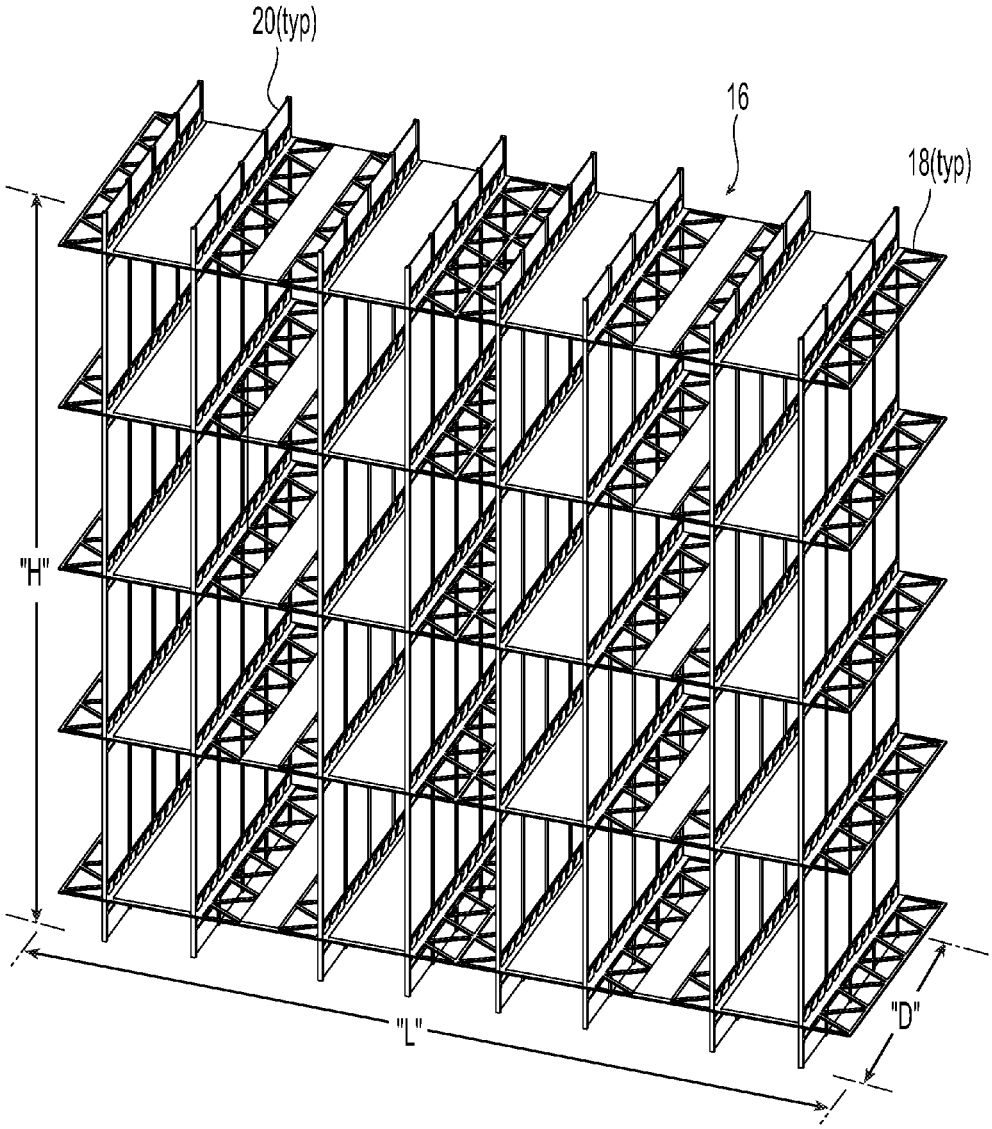
FIG. 5 is an isometric view of an assembled lattice structure including a plurality of row/column interfaces.

Referring now to FIG. 5, an assembled lattice structure 16 is shown. The lattice structure comprises a plurality of row members 18 interlocked with a plurality of column members 20 to form an "egg crate" arrangement. As can be seen, each row member 18 runs the length "L" of the lattice, while each column member 20 runs the entire height "H" of the lattice. Each of the row and column members 18, 20 also has a depth "D." As mentioned, and as will be described in greater detail later, the interlocking design of the row and column members results in a lattice having increase strength and stiffness as compared to previous designs.

Figure 6:
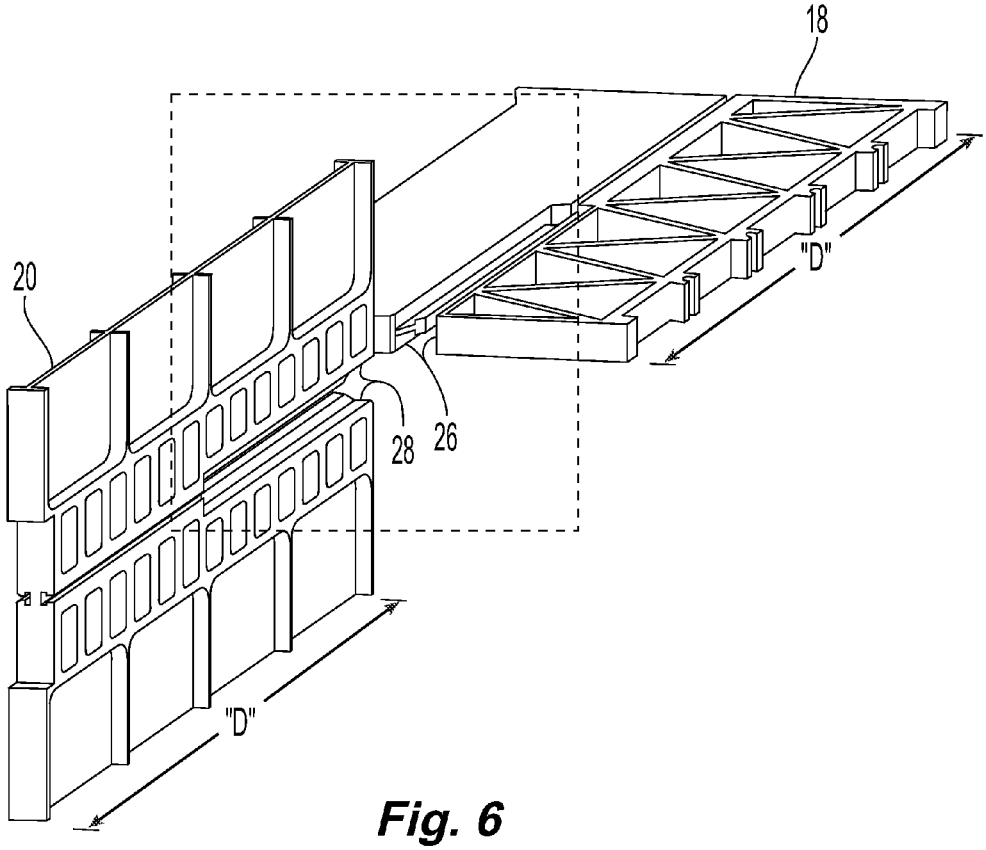
FIG. 6 is an exemplary interface between a row member and a column member in which the interface employs the disclosed interface.
Figure 7:
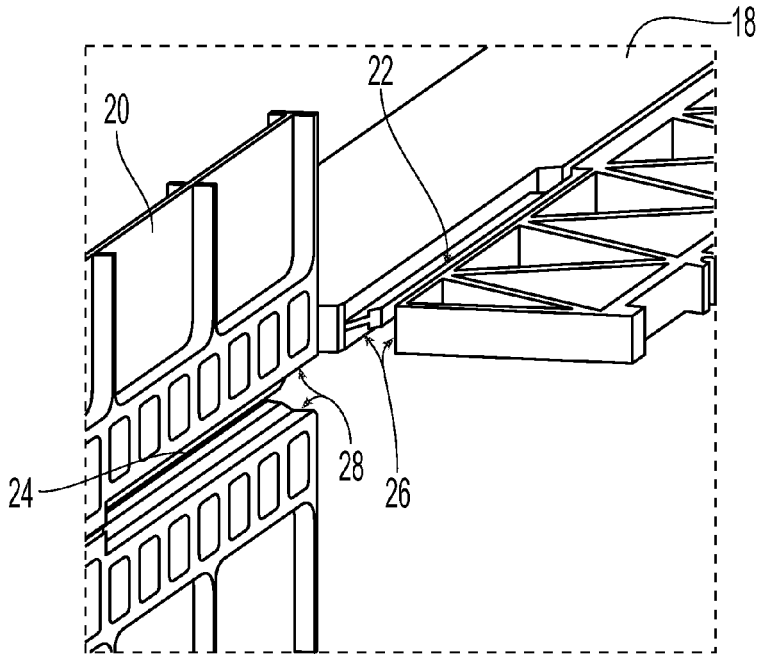
FIG. 7 is a detail view of the interface of FIG. 6.

FIG. 6 shows an exemplary interface between a portion of one row member 18 and a portion of one column member 20. FIG. 7 is an enlarged view of the interface of FIG. 6. Each of the row and column members 18, 20 has a corresponding slot 22, 24 disposed over one half of the depth "D" of the member.

Figure 8:
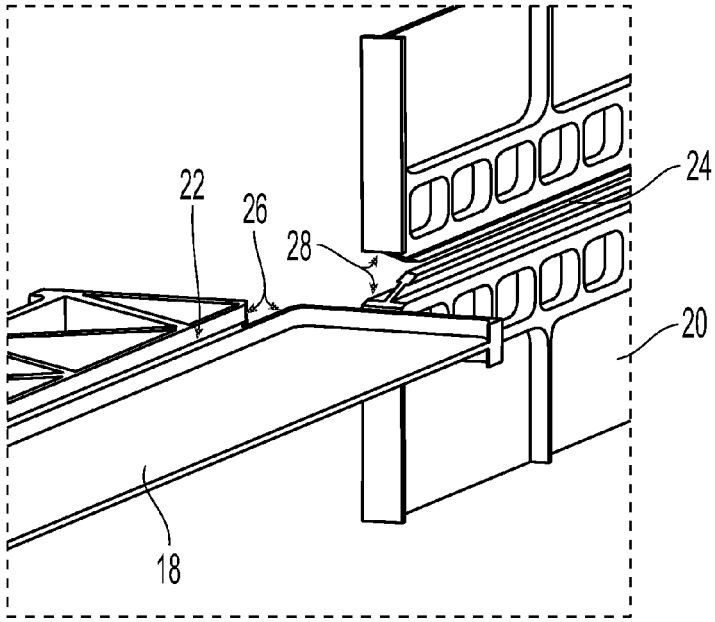
FIG. 8 is a reverse view of the detail view of FIG. 7.

The slots enable the row and column members 18, 20 to inter-fit with each other to form the aforementioned lattice structure 16. A reverse view of this interface is shown in FIG. 8. Visible in FIGS. 6-8 are chamfered lead in surfaces 26, 28 provided at the mouth of each slot 22, 24 of the row and column members 18, 20. The respective chamfers enable the user to easily align and engage opposing slots during fit-up. This is advantageous where a single column member with multiple slots is being fit-up with the slots of multiple row members. These chamfered lead in surfaces 26, 28 facilitate the interconnection of the row and column members 18, 20 during assembly, allowing for easy guidance of the members to align the corresponding slots 22, 24.

Figure 9:
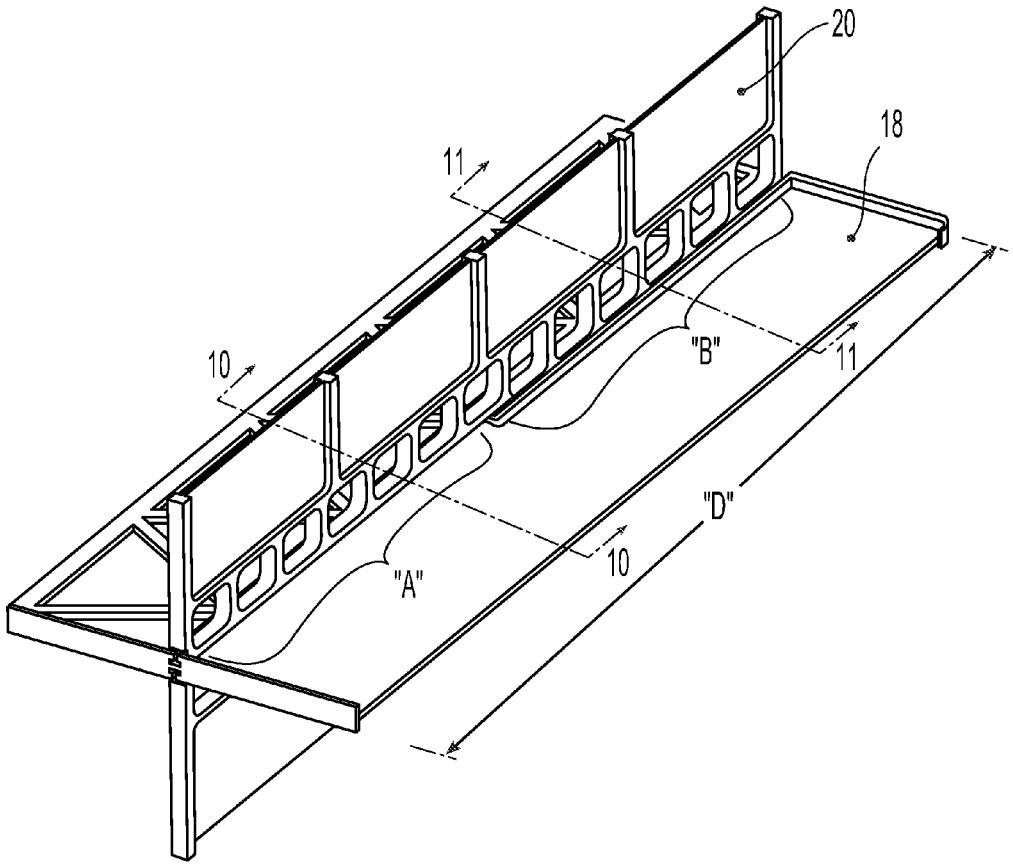
FIG. 9 is an isometric view of a row member connected to a column member using the disclosed interface.

FIG. 9 is an isometric view of the assembled partial row and column members 18, 20. As can be seen, the interconnected structure shown in FIG. 9 consists of two separate engagement regions of the row and column members, namely regions A and B. In engagement region A, the row member 18 is solid and engages the open slot 24 of the column member 20. In engagement region B, the column member 20 is solid and engages the open slot 22 of the row member 18. A cross-section of engagement region "A" is shown in greater detail in FIG. 10, while a cross-section of engagement region "B" is shown in greater detail in FIG. 11.

Figure 10:
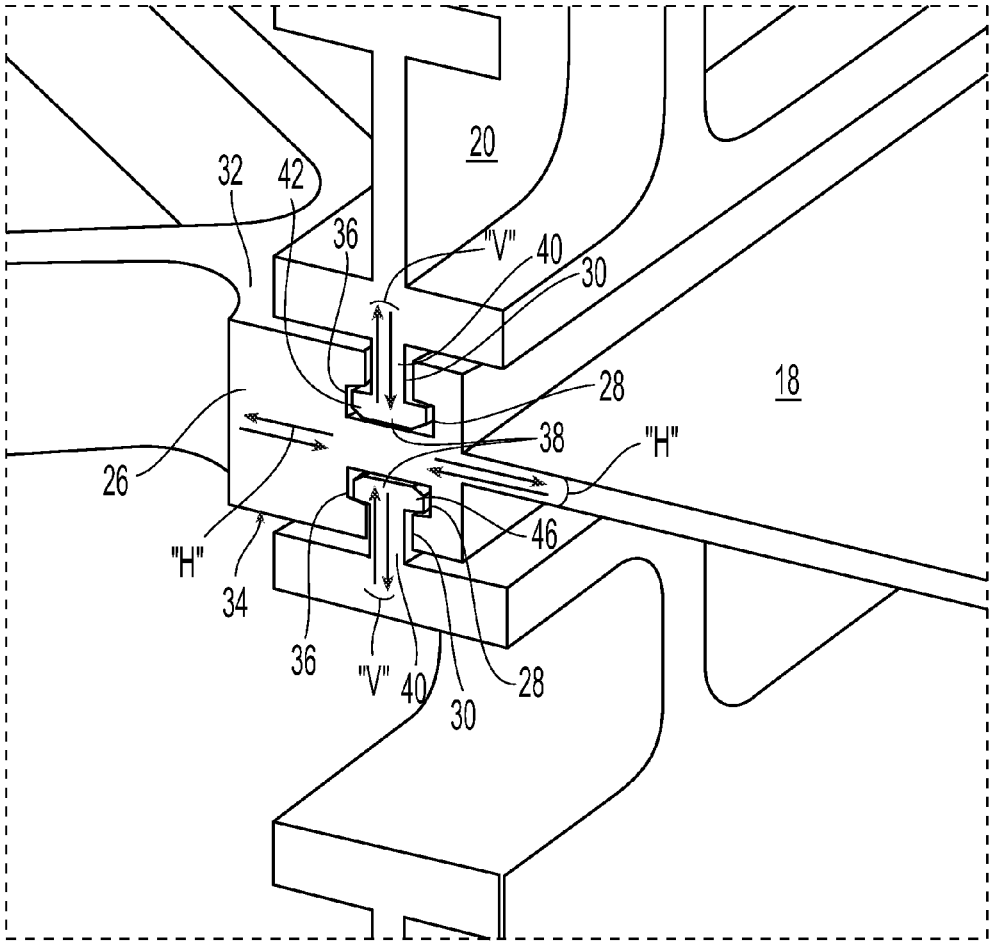
FIG. 10 is a cross-section view taken along line 10-10 of FIG. 9.

Referring to FIG. 10, in region "A" the row member 18 has a centrally located intersection portion 26, within which a pair of opposing recesses 28 have been formed. In the illustrated embodiments, these opposing recesses 28 are T-shaped. More particularly, these T-shaped recesses 28 have recess surfaces shaped to form a throat portion 30 and a channel portion 36. The throat portion 30 intersects with top and bottom surfaces 32, 34 of the intersection portion 26. The throat portion 30 also connects with the channel portion 36. Since the throat portion 30 is relatively narrower than the channel portion 36, and both are rectilinear in shape, the recesses 28 take on a T-shape is cross-section.

The column member 20 comprises a pair of opposing T-shaped protrusions 38 disposed on respective opposing surfaces of the slot 24. The T-shaped protrusions 38 are configured in size and shape to cooperate with the T-shaped recesses 28 of the row member 18. Thus, each protrusion 38 has a relatively narrow web portion 40 and a relatively wider flange portion 42. The opposing protrusions 38 define the slot 24 in column member 20.

Figure 11:
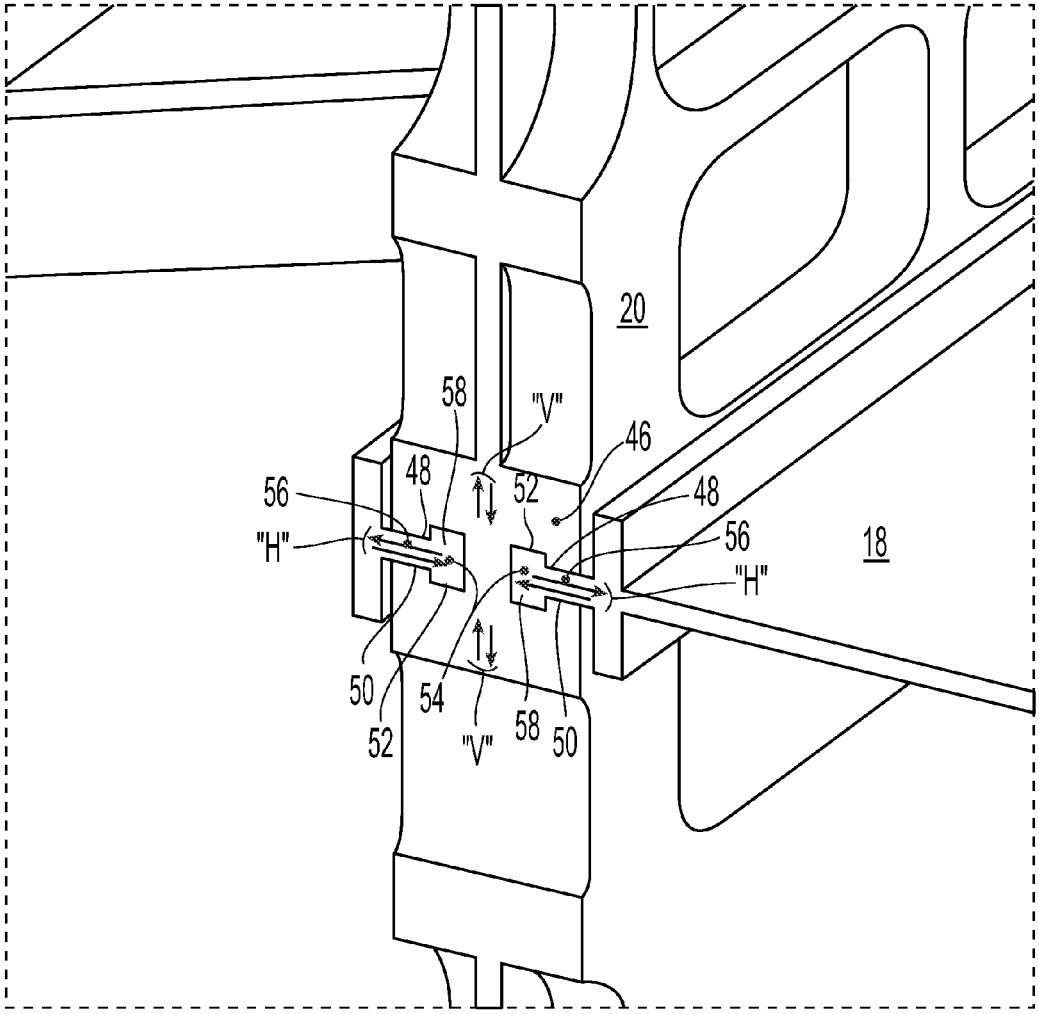
FIG. 11 is a cross-section view taken along line 11-11 of FIG. 9.

Referring to FIG. 11, in region "B" the column member 20 has a centrally located intersection portion 46, within which a pair of opposing T-shaped recesses 48 are formed. These T-shaped recesses 48 are similar to those formed in region "A" of the row member 18, namely, they have a relatively narrow throat portion 50 and a relatively wider channel portion 52. The row member 18 has a pair of opposing T-shaped protrusions 54 disposed on opposing surfaces of the slot 22. The T-shaped protrusions 54 are configured in size and shape to cooperate with the T-shaped recesses 48 of the column member 20, and thus, each protrusion 54 has a relatively narrow web portion 56 and a relatively wider flange portion 58. The opposing protrusions 54 define the slot 22 in row member 18.

Thus arranged, when the row and column members 18, 20 are fully engaged (FIG. 9), in region "A" the web and flange portions 40, 42 of the T-shaped protrusions 38 in the column member 20 are held firmly within the respective throat and channel portions 30, 36 of the T-shaped recesses 28 of the row member 18, while in region "B" the web and flange portions 40, 42 of the T-shaped protrusions 54 of the row member 18 are held firmly within the respective throat and channel portions 50, 52 of the T-shaped recesses 48 of the column member 20. This system of T-shaped recesses and protrusions support and transfer forces between the row and column members in the vertical and horizontal directions, as illustrated by arrows "V" and "H" in FIGS. 10 and 11. This arrangement ensures that tension and compression forces are supported and transferred across the entire depth of each row/column joint.

The row and column members 18, 20 may be made of metal, such as aluminum, to minimize the overall weight of the assembled lattice 16 and array "AT".

The row and column members 18, 20 may be machined from unitary pieces of material, or they may be cast. The advantage of machining the members is that the slots and projections can be fabricated to precise dimensions with tight tolerances that will remain stable when subject to the long term operational environment.

As disclosed, the row and column members 18, 20 are self-aligning so that when assembled (as described below), the rows and columns are accurately positioned vertically, laterally, and rotationally with respect to each other.

Figure 12A:
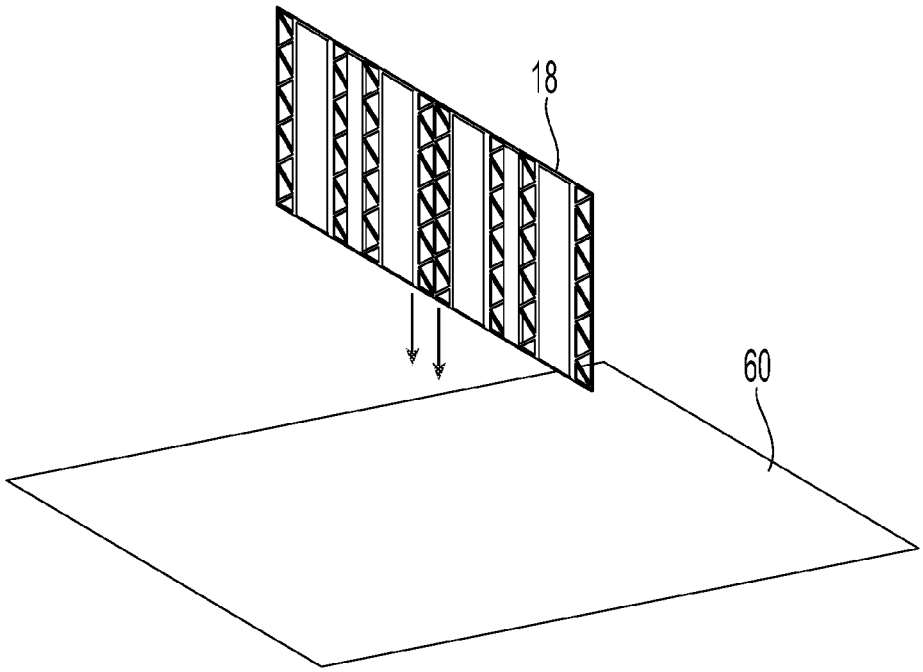
FIG. 12 is an isometric view showing a center row member employing the disclosed interface being installed on a front plate.
Figure 12B:
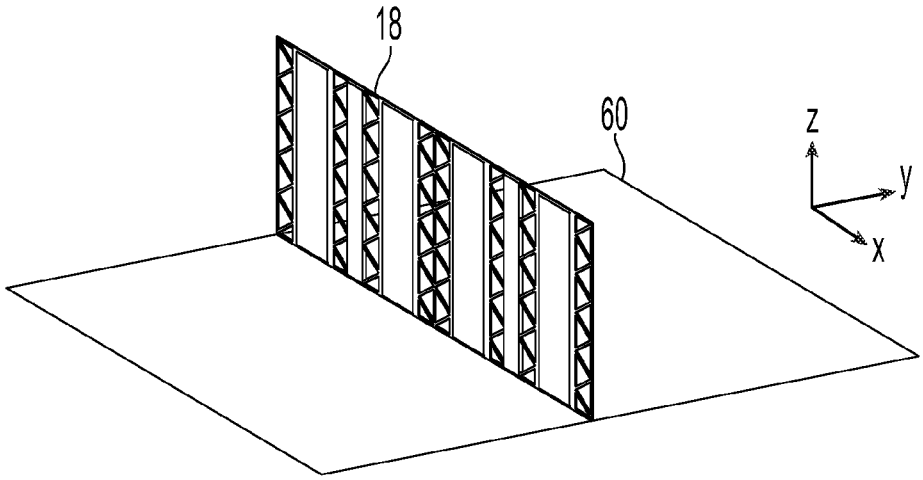
Figure 13A:
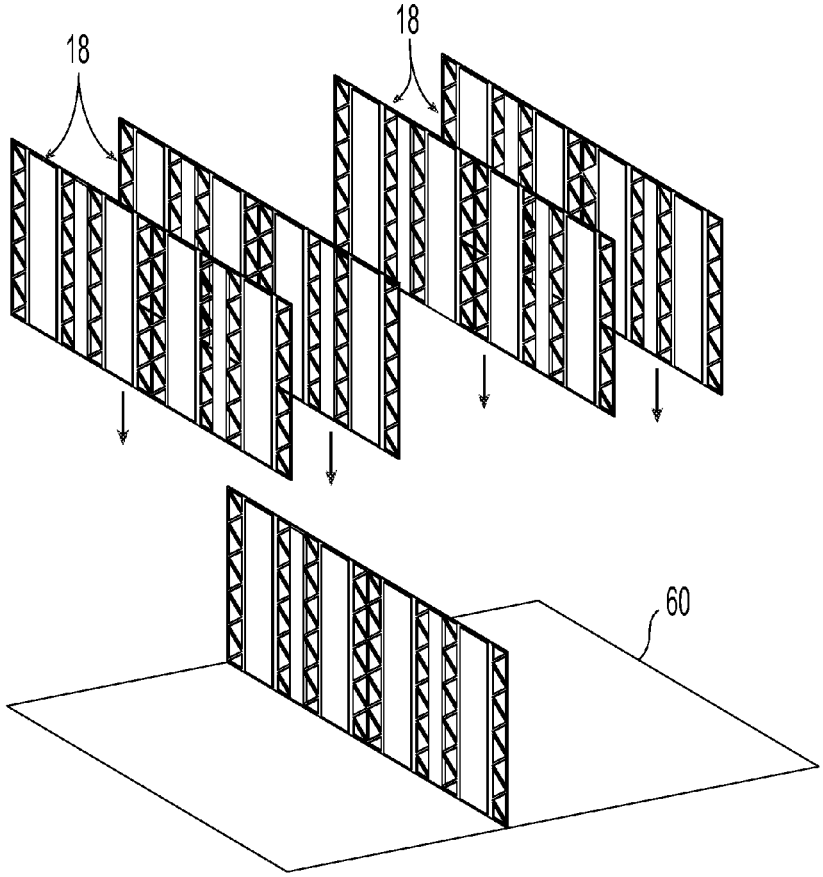
FIG. 13 is an isometric view showing a plurality of additional row member employing the disclosed interface being installed on the front plate of FIG. 12.
Figure 13B:
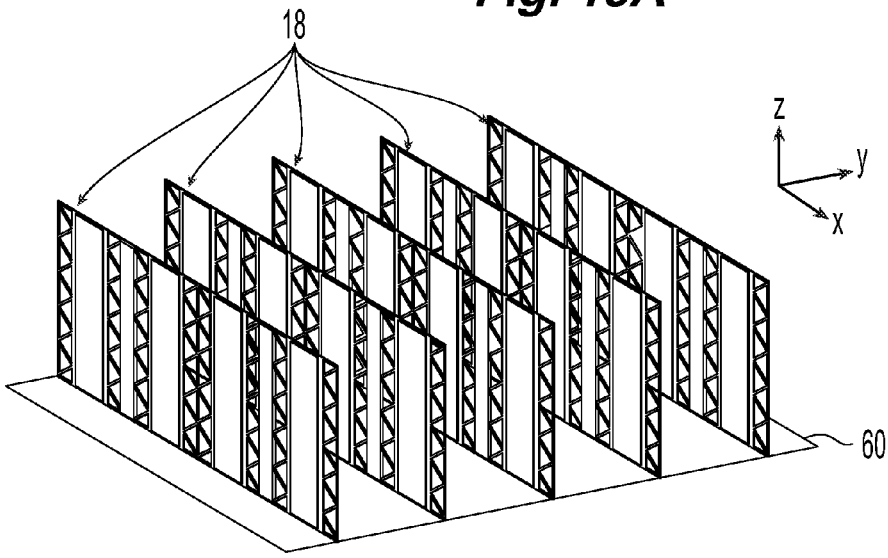

Referring FIGS. 12A to 16, a method of assembling the lattice structure 16 will be described in greater detail. As shown in FIG. 12A, a center row member 18 and a front plate 60 are provided. In FIG. 12B, the center row member 18 is pinned to the front plate 60 so that it is constrained in the y-direction (corresponding to the array vertical). Fasteners (e.g., screws) attaching the front plate to the row are installed, but are left loose to allow the row member 18 to move in the x-direction. In FIGS. 13A and 13B, all other row members 18 are installed on the front plate 60. The other row members 18 are fastened to the front plate 60 (e.g., using screws) such that the row members 18 can move slightly in the x and y directions.

Figure 14A:
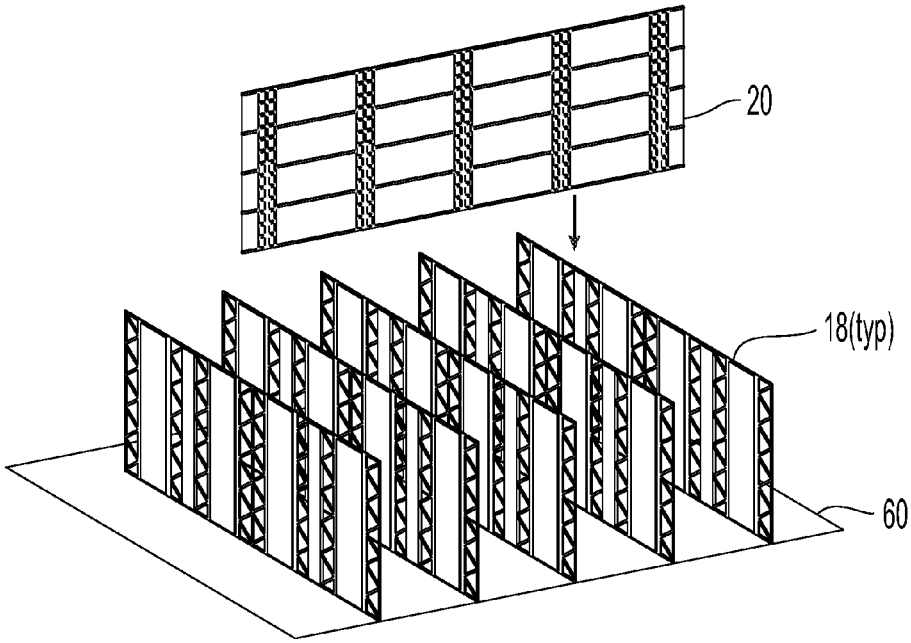
FIGS. 14A-14C are isometric views showing a center column member employing the disclosed interface being installed on the front plate of FIG. 12.
Figure 14B:
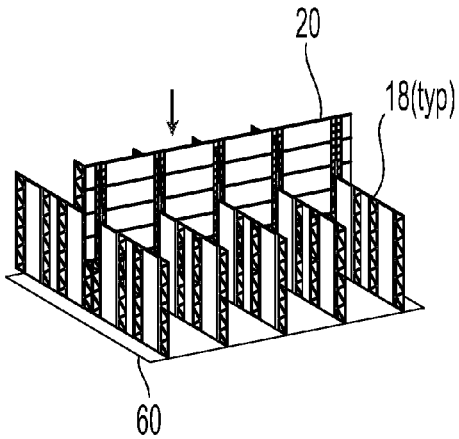
Figure 14C:
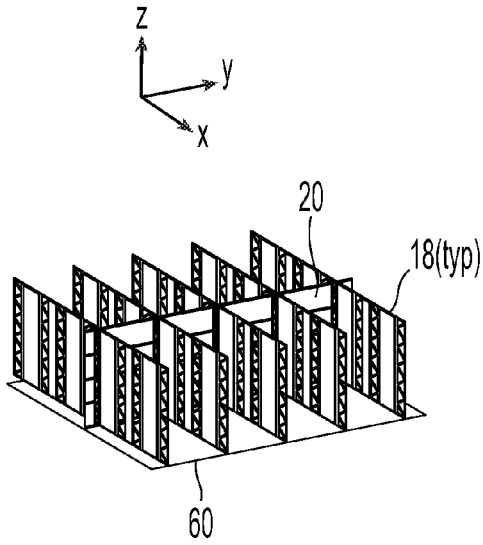

In FIG. 14A, the center column member 20 is aligned with the row members 18 such that the slots on the opposing members align. In FIGS. 14B and 14C, the center column member 20 is pressed down into engagement with the row members 18 and the front plate 60. The center column member 20 is pinned to the front plate 60 so that it is constrained in the x-direction (the array horizontal). This locates all of the row members in the x-direction (the array horizontal). It also locates all rows except the center row in the y-direction (the array vertical). The fasteners attaching the center column 20 to the front plate 60 are installed and tightened.

Figure 15A:
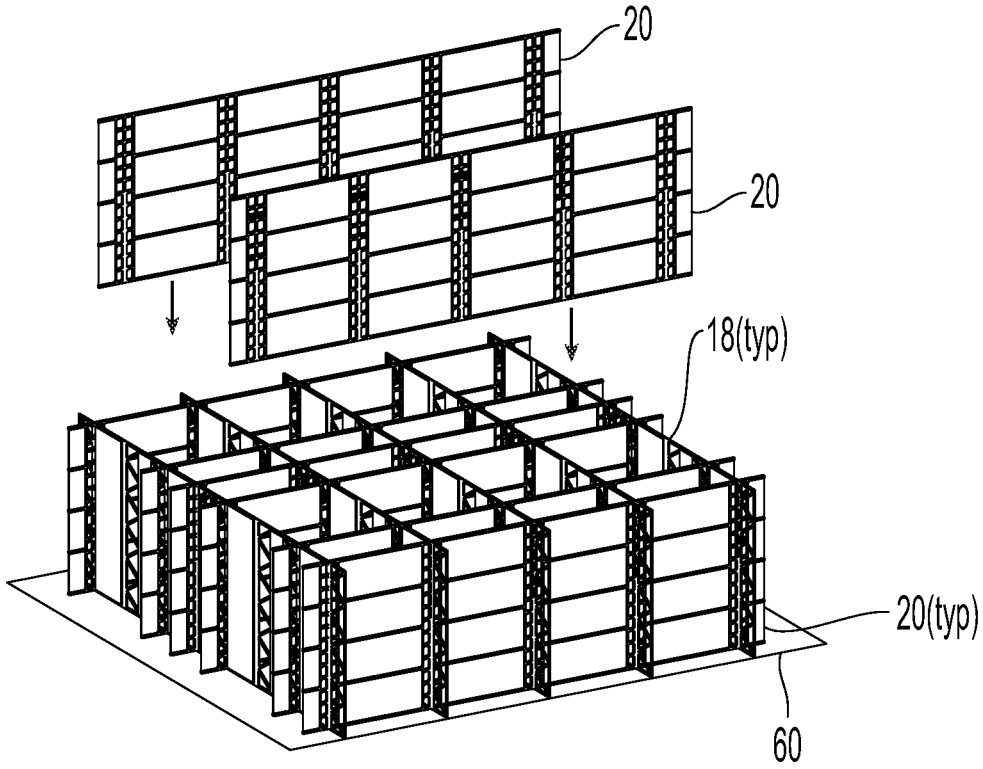
FIG. 15 is an isometric view showing a plurality of additional column members employing the disclosed interface being installed on the front plate of FIG. 12.
Figure 15B:
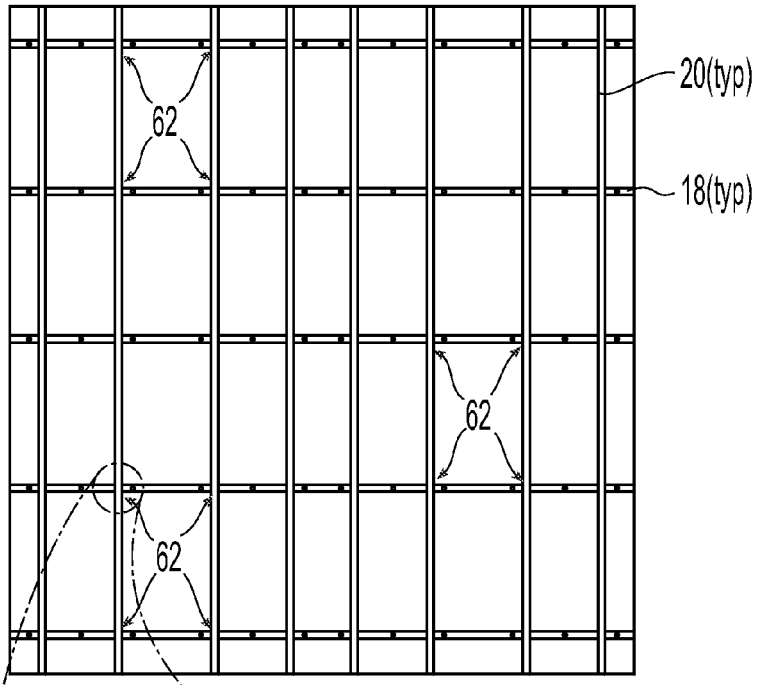
Figure 15C:
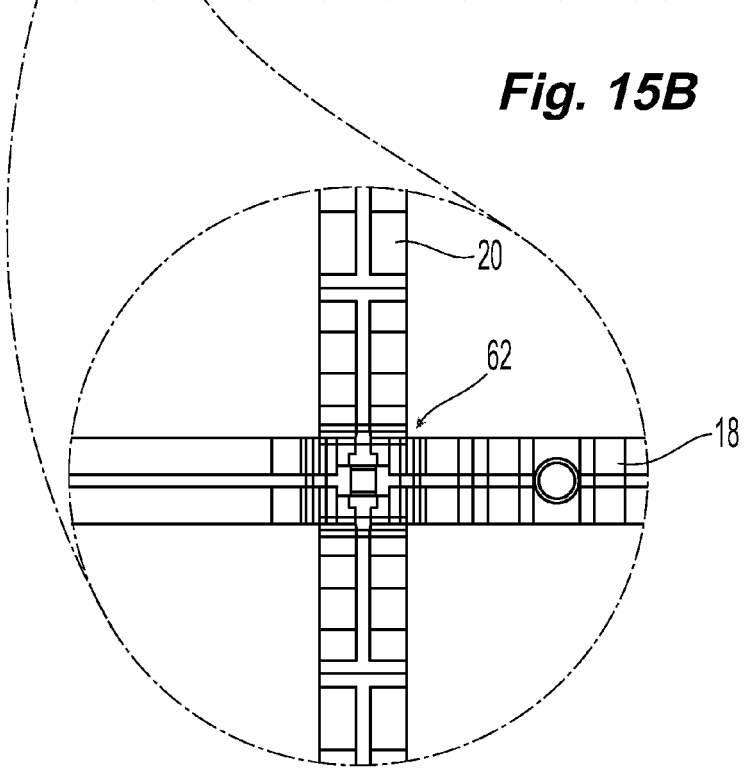

In FIG. 15A, all other column members 20 are installed, in any order. Again, with the slots of the opposing members aligning, the column members 20 are pressed down into engagement with the row members 18 and the front plate 60. With the exception of the center row and column members 18, 20 every column member 20 "locally" locates every row vertically (y-direction) while every row "locally" locates every column horizontally (x-direction). FIGS. 15B and 15C show the interconnection scheme at each row column joint 62, illustrating how the disclosed protrusion/slot arrangement generates this self-alignment. As can be seen, each column and row member includes a plurality of such joints 62.

Figure 16A:
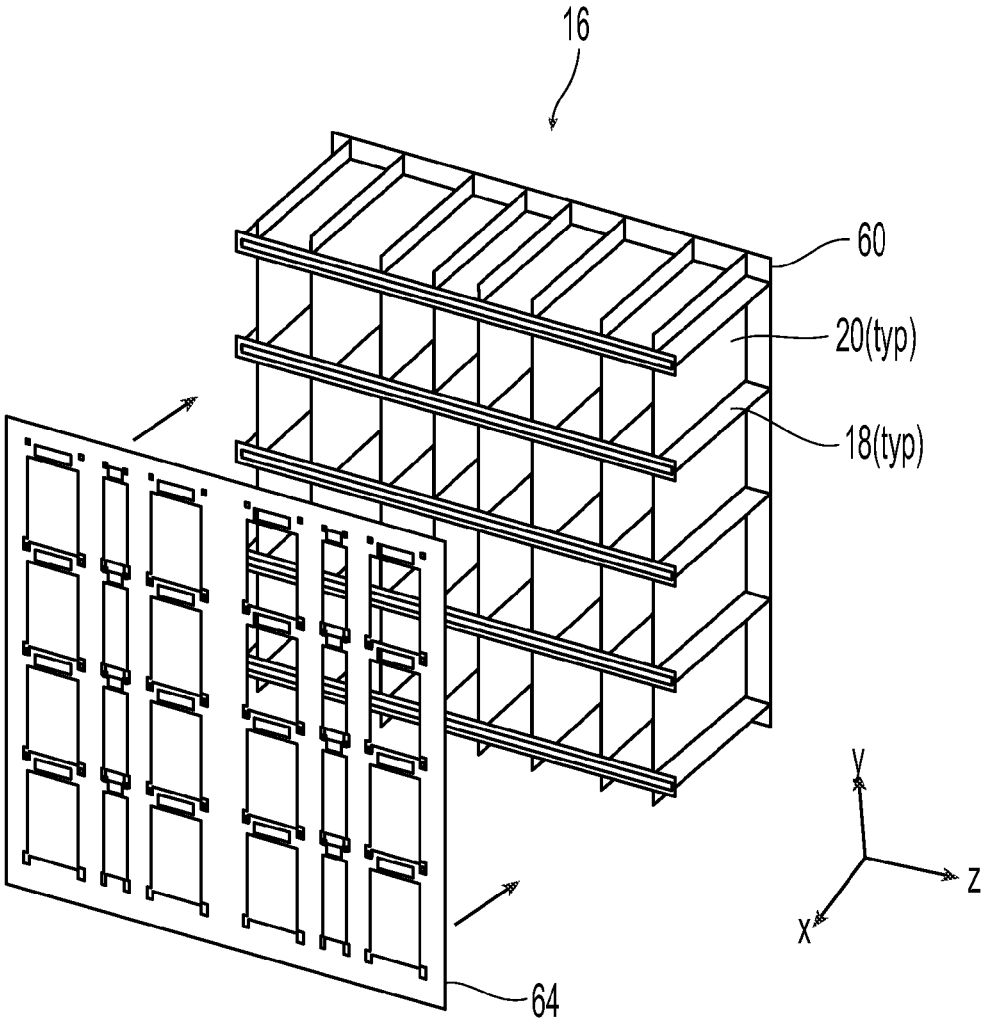
FIGS. 16A-16B are isometric views showing a back plate being installed on the lattice structure resulting from arrangement of FIG. 15.
Figure 16B:
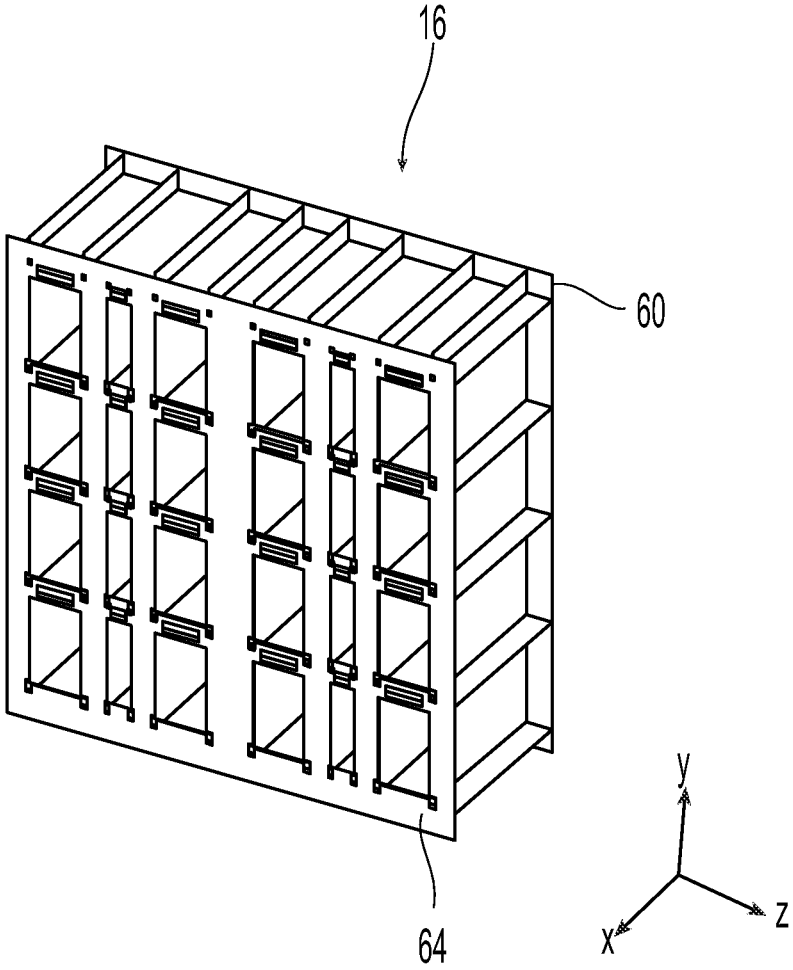

FIGS. 16A and 16B show the installation of the backplate 64, thus completing the lattice structure 16.

Although the system has been described in terms of exemplary embodiments, it is not limited thereto. The features of the system have been disclosed, and further variations will be apparent to persons skilled in the art. All such variations are considered to be within the scope of the appended claims. Reference should be made to the appended claims, rather than the foregoing specification, as indicating the true scope of the disclosed system. The appended claims should be construed broadly, to include such other variants and embodiments of the invention which may be made by those skilled in the art without departing from the scope and range of equivalents of the invention.

What is claimed is:

1. An antenna array structure, comprising:

a row member and a column member, the row and column members having cooperating slots configured to allow the row and column members to interlock to enable assembly of the row and column members into a dimensionally stable lattice;

wherein each slot of the row member and each slot of the column member is defined by respective opposing walls having opposing surfaces, wherein at least one of the opposing surfaces of the opposing walls comprises a geometrically shaped protrusion surface formed thereon, and wherein the protrusion surface is configured to engage with a correspondingly shaped recess of an opposing row or column member.

2. The antenna array structure of claim 1, wherein each of the row and column members has a depth, and the cooperating slots and protrusion surfaces, and recesses transfer forces between the row and column members along the entire depth of each support member.

3. The antenna array structure of claim 1, wherein the cooperating slots and protrusion surfaces have a length that is one half a depth of the associated row or column member.

4. The antenna array structure of claim 3, wherein the recesses have a length that is the remaining one half of the depth of the associated row or column member.

5. The antenna array structure of claim 1, wherein the cooperating slots and protrusion surfaces, and recesses are self aligning.

6. The antenna array structure of claim 1, wherein the cooperating slots and protrusion surfaces, and recesses prevent rotation of the row and column members with respect to each other.

7. The antenna array structure of claim 1, wherein cooperating slots have chamfered lead in surfaces to facilitate engagement of the row member with the column member.

8. The antenna array structure of claim 1, wherein each of the row and column members has a plurality of slots for engagement with a plurality of other row and column members to form the dimensionally stable lattice.

9. The antenna array structure of claim 1, wherein the at least one protrusion surface formed within each of the slots of the row and column members is configured to engage a corresponding recess formed in a top or bottom surface of an opposing row or column member.

10. The antenna array structure of claim 1, wherein each of the opposing walls comprises a protrusion surface formed thereon.

11. The antenna array structure of claim 1, wherein each of the slots of the row and column members extends from a first end of the member to a first depth, and wherein the recesses of the row and column members extend from the end of the slots at the first depth to a second depth.

12. The antenna array structure of claim 11, wherein the second depth comprises a second end of the member, opposite the first end.

13. The antenna array structure of claim 12, wherein the protrusion surfaces and the recesses of the row and column members are configured to engage over the total depth of the row and columns.

14. The antenna array structure of claim 11, wherein the first depth is equal to one half of the total depth of the row or column member.

15. The antenna array structure of claim 14, wherein the second depth is equal to one half of the total depth of the row or column member.

16. An antenna array structure, comprising:

a row member and a column member, the row and column members having cooperating slots configured to allow the row and column members to interlock to enable assembly of the row and column members into a dimensionally stable lattice;

wherein the slots of the row and column members comprise geometrically shaped protrusion surfaces configured to engage with correspondingly shaped recesses of an opposing row or column member and wherein the protrusion surfaces each comprise a T-shape cross-section.

17. The antenna array structure of claim 16, wherein the recesses have a T-shape cross-section sized to engage with the protrusion surfaces.

18. An antenna array lattice, comprising:

a plurality of row and column members each comprising cooperating slots configured to allow pairs of row and column members to lock together into a dimensionally stable lattice;

wherein each of the slots of the plurality of row members and each of the slots of the column members is defined by respective opposing walls having opposing surfaces, wherein at least one of the opposing surfaces of the opposing walls comprises a geometrically shaped protrusion surface formed thereon, and wherein the protrusion surface is configured to engage with a correspondingly shaped recess of opposing row or column members.

19. The antenna array lattice of claim 18, wherein the protrusion surfaces each comprise a T-shape cross-section.

20. The antenna array lattice of claim 19, wherein the recesses have a T-shape cross-section sized to engage with the protrusion surfaces.

21. The antenna array lattice of claim 18, wherein each of the row and column members has a length, and the cooperating slots and protrusion surfaces, and recesses transfer forces between associated row and column members along the entire length of each member.

22. The antenna array lattice of claim 18, wherein the cooperating slots and protrusion surfaces have a length that is one half a depth of the associated row or column member.

23. The antenna array lattice of claim 22, wherein the recesses have a length that is the remaining one half of the depth of the associated row or column member.

24. The antenna array lattice of claim 18, wherein the cooperating slots and protrusion surfaces, and recesses are self aligning.

25. The antenna array lattice of claim 18, wherein the cooperating slots and protrusion surfaces, and recesses prevent rotation of the row and column members with respect to each other.

26. The antenna array lattice of claim 18, wherein cooperating slots have chamfered lead in surfaces to facilitate engagement of the row members with the column members.

27. The antenna array lattice of claim 18, wherein each of the row and column members has a plurality of slots for engagement with a plurality of other row and column members to form the dimensionally stable lattice.

28. An antenna array structure, comprising:

a row member and a column member, the row and column members having cooperating slots configured to allow the row and column members to interlock to enable assembly of the row and column members into a dimensionally stable lattice;

wherein the slots of the row and column members are defined by opposing walls, wherein each of the opposing walls comprises a geometrically shaped protrusion surface formed thereon, and wherein the protrusion surfaces formed on the opposing walls are configured to engage two corresponding recesses formed in a top and bottom surface, respectively, of an opposing row or column member.

29. A member for an antenna array structure comprising:

a body;

a slot formed through the body and defined by opposing interior walls, the slot opening on a first end of the body and extending therefrom in a longitudinal direction toward a second end of the body;

a geometrically shaped protrusion surface formed on at least one of opposing surfaces defining the opposing interior walls; and a recess formed in at least one of a top surface and a bottom surface of the body and extending in the longitudinal direction from the end of the slot toward the second end of the body;

wherein the protrusion surface of the member is configured to engage with a correspondingly shaped recess of another member; and wherein the recess of the member is configured to engage with a correspondingly shaped protrusion surface of the other member, thereby to interlock the members.

30. The member of claim 29, wherein the protrusion surface comprises a first portion having a first thickness and extending from the opposing interior wall, and a second portion having a second thickness greater than the first thickness and distal to the opposing interior wall.

* * * * *